US009887474B2

(12) United States Patent
Chien et al.

(10) Patent No.: US 9,887,474 B2
(45) Date of Patent: Feb. 6, 2018

(54) REINFORCED RIGHT-ANGLE TYPE BOARD EDGE CONNECTOR

(71) Applicant: DELL PRODUCTS, L.P., Round Rock, TX (US)

(72) Inventors: Tung Yu Chien, Taipei (TW); Chih-Wei Chen, Taichung (TW); Ju-Hao Lee, Taipei (TW)

(73) Assignee: Dell Products, L.P., Round Rock, TX (US)

( * ) Notice: Subject to any disclaimer, the term of this patent is extended or adjusted under 35 U.S.C. 154(b) by 0 days.

(21) Appl. No.: 15/349,656

(22) Filed: Nov. 11, 2016

(65) Prior Publication Data

US 2017/0085018 A1 Mar. 23, 2017

Related U.S. Application Data

(63) Continuation of application No. 14/863,420, filed on Sep. 23, 2015, now Pat. No. 9,570,824.

(51) Int. Cl.

| | |
|---|---|
| ***H01R 13/10*** | (2006.01) |
| ***H01R 12/72*** | (2011.01) |
| ***H01R 12/70*** | (2011.01) |
| ***H01R 13/424*** | (2006.01) |
| ***H01R 13/514*** | (2006.01) |
| ***H01R 13/504*** | (2006.01) |

(52) U.S. Cl.

CPC ..... *H01R 12/721* (2013.01); *H01R 12/7076* (2013.01); *H01R 12/724* (2013.01); *H01R 13/424* (2013.01); *H01R 13/504* (2013.01); *H01R 13/514* (2013.01)

(58) Field of Classification Search

CPC ..... H01R 12/721
USPC ..... 439/70, 660, 686, 682
See application file for complete search history.

(56) References Cited

U.S. PATENT DOCUMENTS

| | | | | |
|---|---|---|---|---|
| 4,403,819 A * | 9/1983 | Weber | H01R 12/88 | 439/260 |
| 4,684,194 A * | 8/1987 | Jenkins | H01R 12/89 | 439/260 |
| 4,955,819 A * | 9/1990 | Harting | H01R 12/712 | 29/213.1 |
| 5,137,454 A * | 8/1992 | Baechtle | H01R 12/57 | 439/267 |

(Continued)

*Primary Examiner* — Tulsidas C Patel
*Assistant Examiner* — Peter G Leigh
(74) *Attorney, Agent, or Firm* — Isidore PLLC

(57) ABSTRACT

An information handling system (IHS) includes a reinforced edge card connector having a terminal block having a mounting surface attached to a surface of a first Printed Circuit Board (PCB). A connector housing has a connector opening aligned to the surface of the PCB to receive an edge of a second PCB. An upper row of upper conductors and a lower row of lower conductors are positioned in respective opposition to frictionally engage opposite sides of the edge of the second PCB, wherein the upper conductors are cantilevered pins. The connector housing exposes a bent portion of the cantilevered pins of the upper row of upper conductors. A flexible sheet is attached to an outward surface of the connector housing and to exposed surfaces of the upper row of upper conductors to create a binding force to multiple cantilevered pins to resist deformation.

18 Claims, 7 Drawing Sheets

(56) References Cited

U.S. PATENT DOCUMENTS 5,180,976 A * 1/1993 Van Loan ..... G01R 31/316 324/754.09
5,425,651 A * 6/1995 Thrush ..... H01R 12/83 439/326
5,496,180 A * 3/1996 Fabian ..... H01R 4/028 439/60
5,609,502 A * 3/1997 Thumma ..... H01R 13/40 439/637
5,725,389 A 3/1998 Scheer
5,810,623 A 9/1998 Regnier et al.
6,036,506 A 3/2000 Korsunsky
6,406,332 B1 6/2002 Buican et al.
6,439,931 B1 * 8/2002 Niitsu ..... H01R 23/6873 439/660
6,634,889 B2 10/2003 Miller et al.
6,638,104 B2 * 10/2003 Hashimoto ..... H01R 12/707 439/567
6,790,054 B1 9/2004 Boonsue
7,140,900 B1 11/2006 Villanueva
7,168,987 B1 1/2007 Morohoshi et al.
7,202,686 B2 * 4/2007 Sakiyama ..... G01R 1/0466 324/756.02
7,497,713 B1 * 3/2009 Huettner ..... H01R 27/00 439/265
7,841,872 B2 11/2010 Zhang et al.
8,221,139 B2 7/2012 Qin et al.
8,545,272 B2 10/2013 Lee et al.
8,597,056 B2 * 12/2013 Blanchfield ..... H01R 12/721 439/630
8,690,589 B2 * 4/2014 Ngo ..... H01R 12/7052 439/630
9,033,744 B2 5/2015 Chen
9,049,800 B2 6/2015 Shelnutt et al.
2004/0185692 A1 9/2004 Boonsue
2008/0168204 A1 7/2008 Sultenfuss et al.
2010/0184339 A1 * 7/2010 Ngo ..... H01R 12/7088 439/682
2011/0255233 A1 * 10/2011 Jackson ..... G06F 1/185 361/679.32

* cited by examiner

REINFORCED RIGHT-ANGLE TYPE BOARD EDGE CONNECTOR

RELATED APPLICATION

This application is a continuation of U.S. patent application Ser. No. 14/863,420, filed Sep. 23, 2015, which is fully incorporated herein by reference.

BACKGROUND

1. Technical Field

The present disclosure relates in general to assembly and interconnection of an information handling system (IHS), and more particularly to edge card connectors of an IHS.

2. Description of the Related Art

As the value and use of information continue to increase, individuals and businesses seek additional ways to process and store information. One option available to users is information handling systems (IHSes). An IHS generally processes, compiles, stores, and/or communicates information or data for business, personal, or other purposes, thereby allowing users to take advantage of the value of the information. Because technology and information handling needs and requirements vary between different users or applications, IHSes may also vary regarding what information is handled, how the information is handled, how much information is processed, stored, or communicated, and how quickly and efficiently the information may be processed, stored, or communicated. The variations in IHSes allow for IHSes to be general or configured for a specific user or specific use such as financial transaction processing, airline reservations, enterprise data storage, or global communications. In addition, IHSes may include a variety of hardware and software components that may be configured to process, store, and communicate information and may include one or more computer systems, data storage systems, and networking systems.

IHSs are typically designed with a printed circuit board (PCB) on which functional components are electrically and/or communicatively attached. These PCBs are in turn designed to accommodate attachment of/by one or more connectors of the functional component or card, such as an edge card connector. FIG. 1 illustrates a generally-known right angle edge card connector 100 including a female connector body 102 having a right angle mounting provided by a terminal block 104 that attaches to an edge 106 of a printed circuit board (PCB) 108. In a particular development, such an edge card connector 100 was used in a 2 U server system with four (4) half-width insertion and removable sleds. During blind insertion on the assembly line, manufacturing experienced over 30% failure rate. Top conductors 110 and bottom conductors 112 were being deformed during insertion of a second PCB 114, resulting in a poor electrical connection.

FIGS. 1-2 illustrate a generally-known lance feature 124 of the upper conductors 110 that form an interference attachment between a connector block 126 and a terminal block 128 (FIG. 1).

With continued reference to FIG. 1, an investigation was conducted into root causes of the failures during blind insertion of right angle edge card connectors 100. Design margin of pins retention feature in the connector was not enough to avoid damage against the insertion friction force created during insertion. FIG. 3 illustrates a predicted 0.70 mm rearward deformation 116 of an upper conductor 110' that undergoes a 1.5 N force at its distal end 118. FIG. 4 illustrates a predicted 0.27 mm rearward deformation 120 of a lower conductor 112' that undergoes a 22.5 N force at its distal end 122.

TABLE 1 lists predicted deformation as a function of force applied to a distal end of each lower conductor 112'. TABLE 2 lists predicted deformation as a function of force applied to a distal end of each upper conductor 110'.

TABLE 1

| Lower Row of Terminal | |
|---|---|
| Displacement (mm) | Force (foot-lbs) |
| 0.05 | 0.85 |
| 0.10 | 2.10 |
| 0.15 | 3.00 |
| 0.20 | 4.00 |
| 0.25 | 4.40 |
| 0.27 | 5.00 |

TABLE 2

| Upper Row of Terminal | |
|---|---|
| Displacement (mm) | Force (foot-lbs) |
| 0.1 | 0.04 |
| 0.2 | 0.11 |
| 0.3 | 0.15 |
| 0.4 | 0.20 |
| 0.5 | 0.24 |
| 0.6 | 0.29 |
| 0.7 | 0.33 |

BRIEF SUMMARY

In accordance with the teachings of the present disclosure, an information handling system (IHS) includes a first printed circuit board (PCB) received in a housing. An edge card connector includes a terminal block having a mounting surface attached to a surface of the first PCB. A connector housing has a connector opening aligned to the surface of the PCB to receive an edge of a second PCB. An upper row of upper conductors and a lower row of lower conductors are positioned in respective opposition to frictionally engage opposite sides of the edge of the second PCB. Each of the upper conductors includes: (i) a cantilevered pin with a distal portion deflected outwardly from the first PCB within the connector opening of connector housing, (ii) a mounting portion that extends to the mounting surface of the terminal block, and (iii) a bent portion that is attached between the distal portion and the mounting portion. The connector housing exposes the bent portion of the cantilevered pins of the upper row of upper conductors. A flexible sheet is attached to an outward surface of the connector housing and to exposed surfaces of the upper row of upper conductors to create a binding force across multiple cantilevered pins to resist deformation.

In accordance with embodiments of the present disclosure, an edge card connector is provided for mounting on a PCB of an IHS. In one or more embodiments, the edge card connector includes a terminal block having a mounting surface attachable to a surface of a first PCB. A connector housing has a connector opening aligned to the surface of the PCB to receive an edge of a second PCB. An upper row of upper conductors and a lower row of lower conductors are positioned in respective opposition to frictionally engage opposite sides of the edge of the second PCB. Each of the upper conductors includes: (i) a cantilevered pin with a distal portion deflected outwardly from the first PCB within the connector opening of connector housing, (ii) a mounting portion that extends to the mounting surface of the terminal block, and (iii) a bent portion that is attached between the distal portion and the mounting portion. The connector housing exposes the bent portion of the cantilevered pins of the upper row of upper conductors. A flexible sheet is attached to an outward surface of the connector housing and to exposed surfaces of the upper row of upper conductors to create a binding force to multiple cantilevered pins to resist deformation.

According to illustrative embodiments of the present disclosure, a method is provided for fabricating a reinforced edge card connector for mounting on a first PCB of an IHS. In one or more embodiments, the method includes forming an upper row of upper conductors and a lower row of lower conductors, where each of the upper conductors comprises a distal portion that deflects outwardly from the first PCB within the connector opening of connector housing. The upper conductors also include a mounting portion and a bent portion that connects the distal portion to the mounting portion. The method includes forming a terminal block proximally attached to mounting portion of the upper row of upper conductors and the lower row of lower conductors, positioned in respective opposition to frictionally engage opposite sides of the edge of a second PCB. The method includes attaching a mounting surface of a terminal block to a surface of a first PCB. The method includes attaching, to the terminal block, a connector housing having connector opening aligned to the surface of the first PCB to receive an edge of the second PCB. The method includes attaching a flexible sheet attached to an outward surface of the connector housing and to exposed surfaces of the upper row of upper conductors to create a binding force to multiple cantilevered pins to resist deformation.

The above presents a general summary of several aspects of the disclosure in order to provide a basic understanding of at least some aspects of the disclosure. The above summary contains simplifications, generalizations and omissions of detail and is not intended as a comprehensive description of the claimed subject matter but, rather, is intended to provide a brief overview of some of the functionality associated therewith. The summary is not intended to delineate the scope of the claims, and the summary merely presents some concepts of the disclosure in a general form as a prelude to the more detailed description that follows. Other systems, methods, functionality, features and advantages of the claimed subject matter will be or will become apparent to one with skill in the art upon examination of the following figures and detailed written description.

BRIEF DESCRIPTION OF THE DRAWINGS

The description of the illustrative embodiments can be read in conjunction with the accompanying figures. It will be appreciated that for simplicity and clarity of illustration, elements illustrated in the figures have not necessarily been drawn to scale. For example, the dimensions of some of the elements are exaggerated relative to other elements. Embodiments incorporating teachings of the present disclosure are shown and described with respect to the figures presented herein, in which.

DETAILED DESCRIPTION

Figure 1:
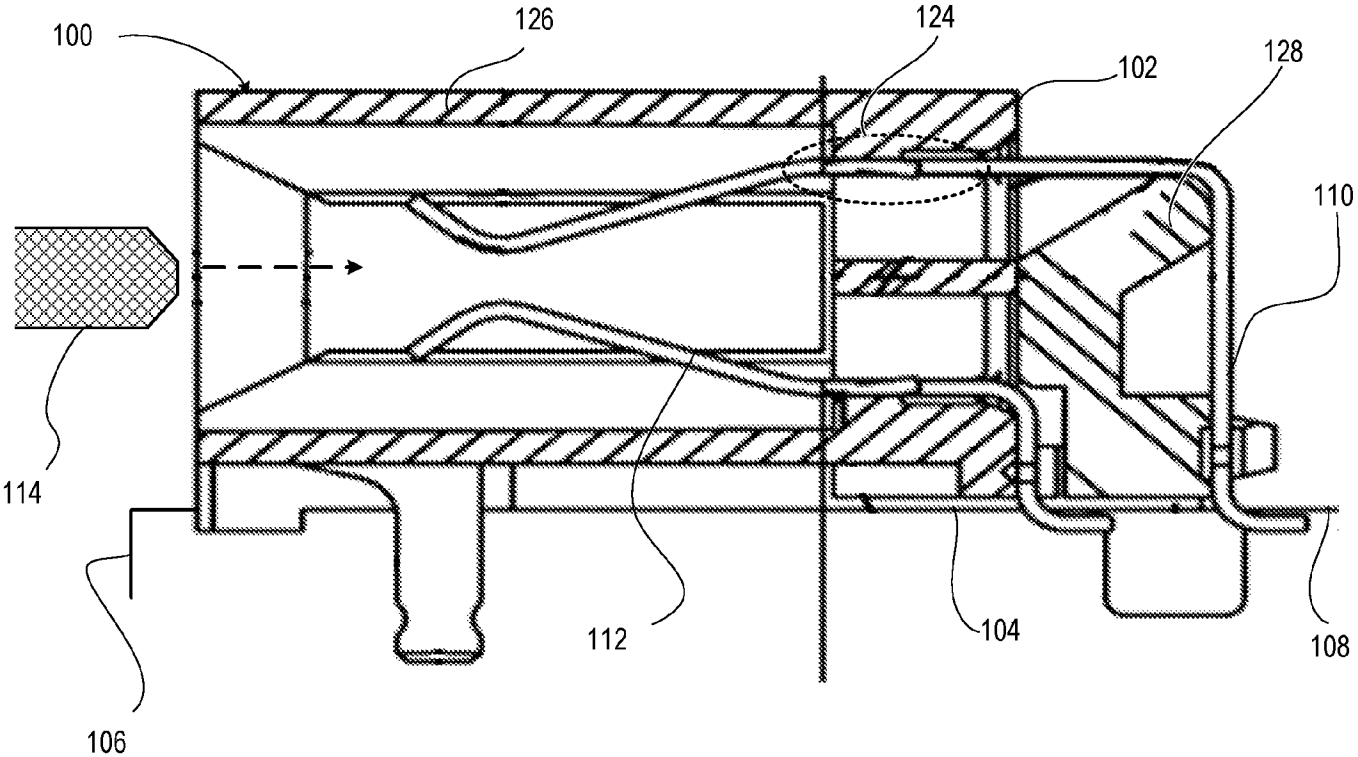
FIG. 1 (Prior Art)
FIG. 1 illustrates a side view in cross section of a generally-known edge card connector mounted on a Printed Circuit Board (PCB)
Figure 2:
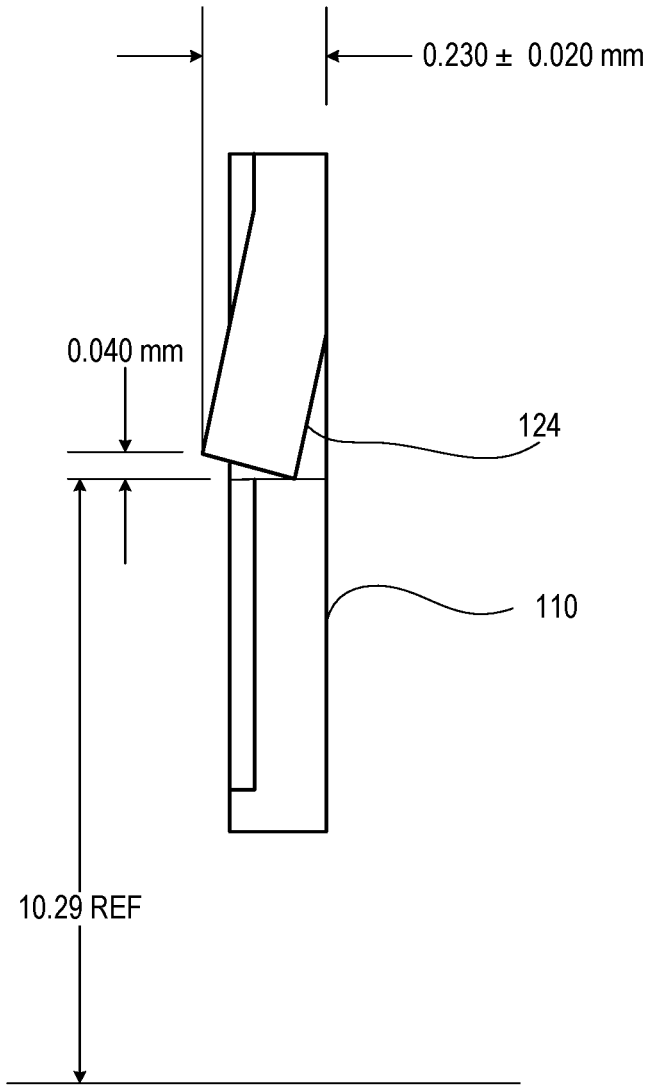
FIG. 2 (Prior Art)
FIG. 2 illustrates a top view of a generally known lance feature of a terminal of the generally-known edge card connector.
Figure 3:
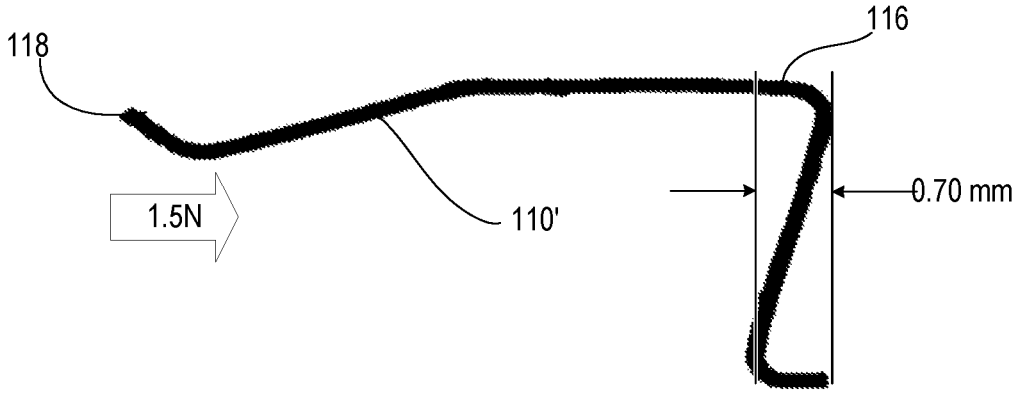
FIG. 3 (Prior Art)
FIG. 3 illustrates a side view of an upper conductor of the generally known edge card connector of FIG. 1 deformed by impact during blind insertion of a pin.
Figure 4:
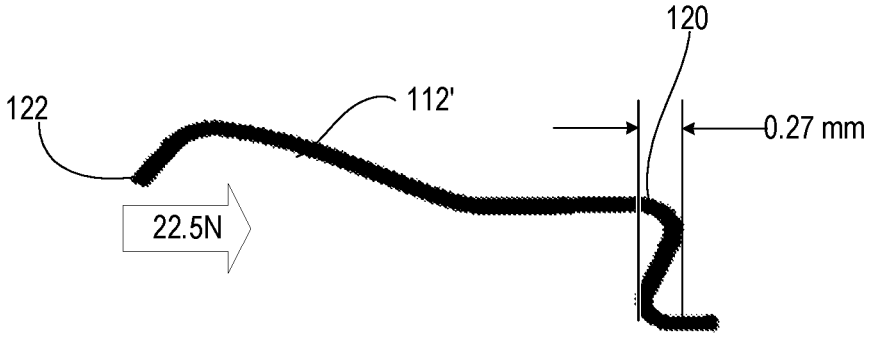
FIG. 4 (Prior Art)
FIG. 4 illustrates a side view of a lower conductor of the generally known edge card connector of FIG. 1 deformed by impact during blind insertion of a pin.

An information handling system (IHS) includes a reinforced edge card connector having a terminal block having a mounting surface attached to a surface of a first Printed Circuit Board (PCB). A connector housing has connector opening aligned to the surface of the PCB to receive an edge of a second PCB. An upper row of upper conductors and a lower row of lower conductors are positioned in respective opposition to frictionally engage opposite sides of the edge of the second PCB, wherein the upper conductors are cantilevered pins. The connector housing exposes a bent portion of the cantilevered pins of the upper row of upper conductors. A flexible sheet is attached to an outward surface of the connector housing and to exposed surfaces of the upper row of upper conductors to create a binding force to multiple cantilevered pins to resist deformation.

The present innovation addresses the discovered root causes of deformed conductors during blind insertion by providing a reinforced sheet that is adhered to the connector and a proximal portion of the upper conductors. A solid binding force maintains multiple upper conductors (pins) together, achieving additional shear resistance and normal retention force than a single, unreinforced pin against the friction force. The approach can be extended to similar usage for PCI-e interface connections in the server industry and for future generations of motherboards.

In the following detailed description of exemplary embodiments of the disclosure, specific exemplary embodiments in which the disclosure may be practiced are described in sufficient detail to enable those skilled in the art to practice the disclosed embodiments. For example, specific details such as specific method orders, structures, elements, and connections have been presented herein. However, it is to be understood that the specific details presented need not be utilized to practice embodiments of the present disclosure. It is also to be understood that other embodiments may be utilized and that logical, architectural, programmatic, mechanical, electrical and other changes may be made without departing from general scope of the disclosure. The following detailed description is, therefore, not to be taken in a limiting sense, and the scope of the present disclosure is defined by the appended claims and equivalents thereof.

References within the specification to "one embodiment," "an embodiment," "embodiments", or "one or more embodiments" are intended to indicate that a particular feature, structure, or characteristic described in connection with the embodiment is included in at least one embodiment of the present disclosure. The appearance of such phrases in various places within the specification are not necessarily all referring to the same embodiment, nor are separate or alternative embodiments mutually exclusive of other embodiments. Further, various features are described which may be exhibited by some embodiments and not by others. Similarly, various requirements are described which may be requirements for some embodiments but not other embodiments.

It is understood that the use of specific component, device and/or parameter names and/or corresponding acronyms thereof, such as those of the executing utility, logic, and/or firmware described herein, are for example only and not meant to imply any limitations on the described embodiments. The embodiments may thus be described with different nomenclature and/or terminology utilized to describe the components, devices, parameters, methods and/or functions herein, without limitation. References to any specific protocol or proprietary name in describing one or more elements, features or concepts of the embodiments are provided solely as examples of one implementation, and such references do not limit the extension of the claimed embodiments to embodiments in which different element, feature, protocol, or concept names are utilized. Thus, each term utilized herein is to be given its broadest interpretation given the context in which that terms is utilized.

Figure 5:
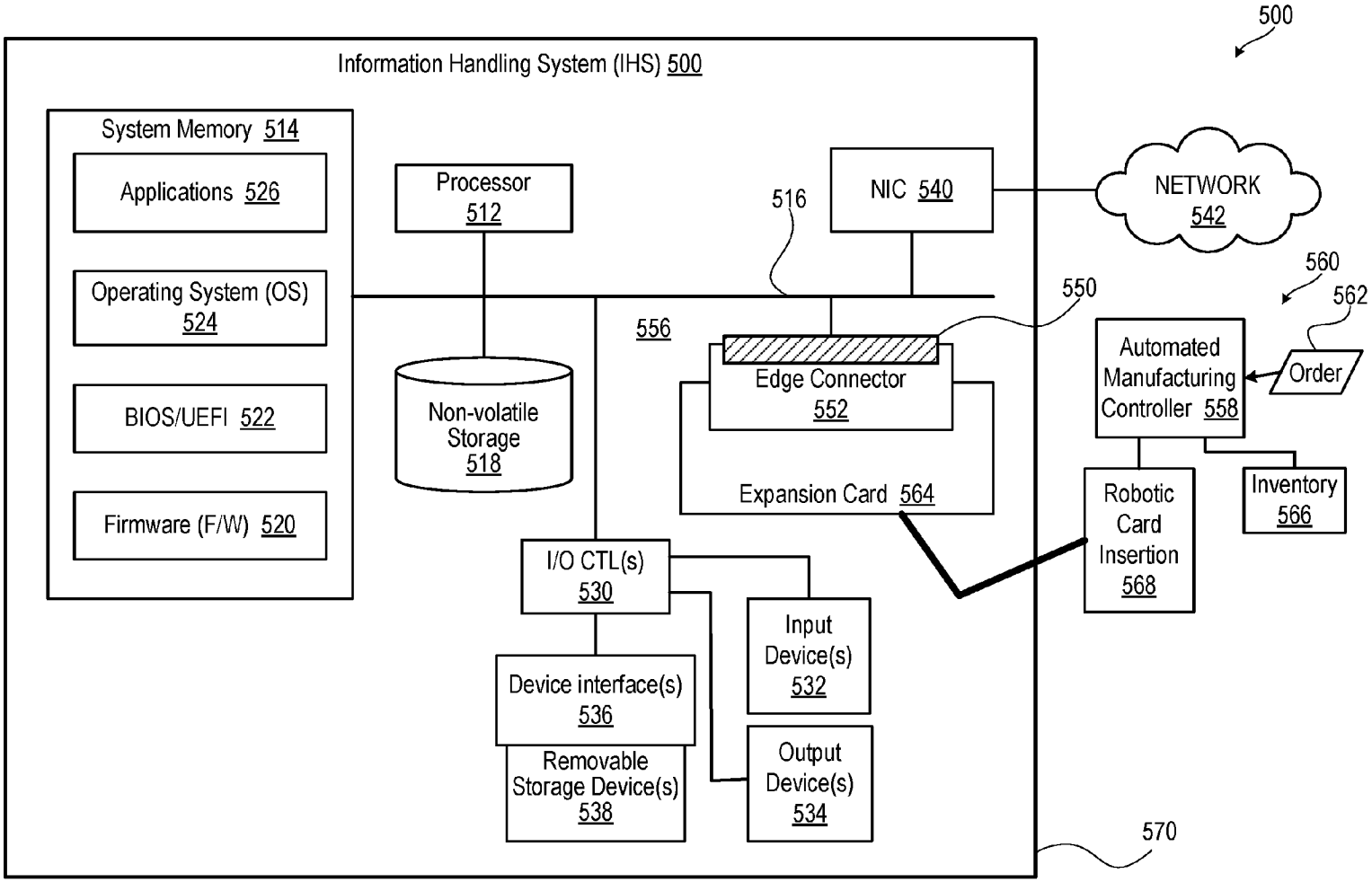
FIG. 5 illustrates a block diagram representation of an example information handling system (IHS) with a reinforced edge card connector, according to one or more embodiments.

FIG. 5 illustrates a block diagram representation of an example information handling system (IHS) 500 that has reinforced right angle edge card connectors to avoid failures during automated assembly. Within the general context of IHSes, IHS 500 may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, entertainment, or other purposes. For example, an IHS may be a personal computer, a PDA, a consumer electronic device, a network storage device, or any other suitable device and may vary in size, shape, performance, functionality, and price.

IHS 500 includes at least one central processing unit (CPU) or processor 512 coupled to a system memory 514 via a system interconnect 516. System interconnect 516 can be interchangeably referred to as a system bus, in one or more embodiments. Also coupled to system interconnect 516 is non-volatile storage (e.g., a non-volatile random access memory (NVRAM)) 518, within which can be stored one or more software and/or firmware modules and one or more sets of data that can be utilized during management operations of IHS 500. These one or more software and/or firmware modules can be loaded into system memory 514 during operation of management IHS 500. Specifically, in one embodiment, system memory 514 can include therein a plurality of such modules, including one or more of firmware (F/W) 520, basic input/output system (BIOS) or Uniform Extensible Firmware Interface (UEFI) 522, operating system (OS) 524, and application(s) 526. These software and/or firmware modules have varying functionality when their corresponding program code is executed by CPU 512 or secondary processing devices within management IHS 500. For example, application(s) 526 may include a word processing application, a presentation application, and a management station application, among other applications.

IHS 500 further includes one or more input/output (I/O) controllers 530 which support connection by, and processing of, signals from one or more connected input device(s) 532, such as a keyboard, mouse, touch screen, or microphone. I/O controllers 530 also support connection to, and forwarding of, output signals to one or more connected output devices 534, such as a monitor or display device or audio speaker(s). Additionally, in one or more embodiments, one or more device interfaces 536, such as an optical reader, a USB, a card reader, Personal Computer Memory Card International Association (PCMCIA) slot, and/or a high-definition multimedia interface (HDMI), can be associated with IHS 500. Device interface(s) 536 can be utilized to enable data to be read from, or stored to, corresponding removable storage device(s) 538, such as a compact disk (CD), digital video disk (DVD), flash drive, or flash memory card. In one or more embodiments, device interface(s) 536 can further include general purpose I/O interfaces such as inter-integrated circuit ($I^2C$), system management bus (SMB), and peripheral component interconnect (PCI) buses.

IHS 500 comprises a network interface controller (NIC) 540. NIC 540 enables IHS 500 and/or components within IHS 500 to communicate and/or interface with other devices, services, and components that are located external to IHS 500. These devices, services, and components can interface with IHS 500 via an external network, such as example network 542. According to one aspect of the disclosure, NIC 540 represents a communication mechanism that enables the IHS to communicate with one or more clients, as described in greater detail hereinafter. Network 542 can be a local area network, wide area network, personal area network, and the like, and the connection to and/or between network 542 and IHS 500 can be wired or wireless or a combination thereof. For purposes of discussion, network 542 is indicated as a single collective component for simplicity. However, it should be appreciated that network 542 can comprise one or more direct connections to other devices as well as a more complex set of interconnections as can exist within a wide area network, such as the Internet.

IHS 500 includes increased configurability and manufacturability by having a reinforcement component 550 on an edge card connector 552 that is mounted on a first Printed Circuit Board (PCB) 556 such as mother board (MB) that includes computing components of the IHS 500. The reinforcement component 550 prevents damage during assembly of the IHS 500 at an Original Equipment Manufacturer (OEM). An automated manufacturing controller 558 of an automated manufacturing system 560 can respond to an order 562 by executing instructions that directs a configuration of the IHS 500. The automated manufacturing controller 558 can draw a selected second PCB such as a PCI-E expansion card 564 from an automated inventory system 566. A robotic card insertion 568 can perform a blind insertion of the expansion card 564 into the edge cardconnector 552 within a chassis 570 of the IHS 500.

Figure 6:
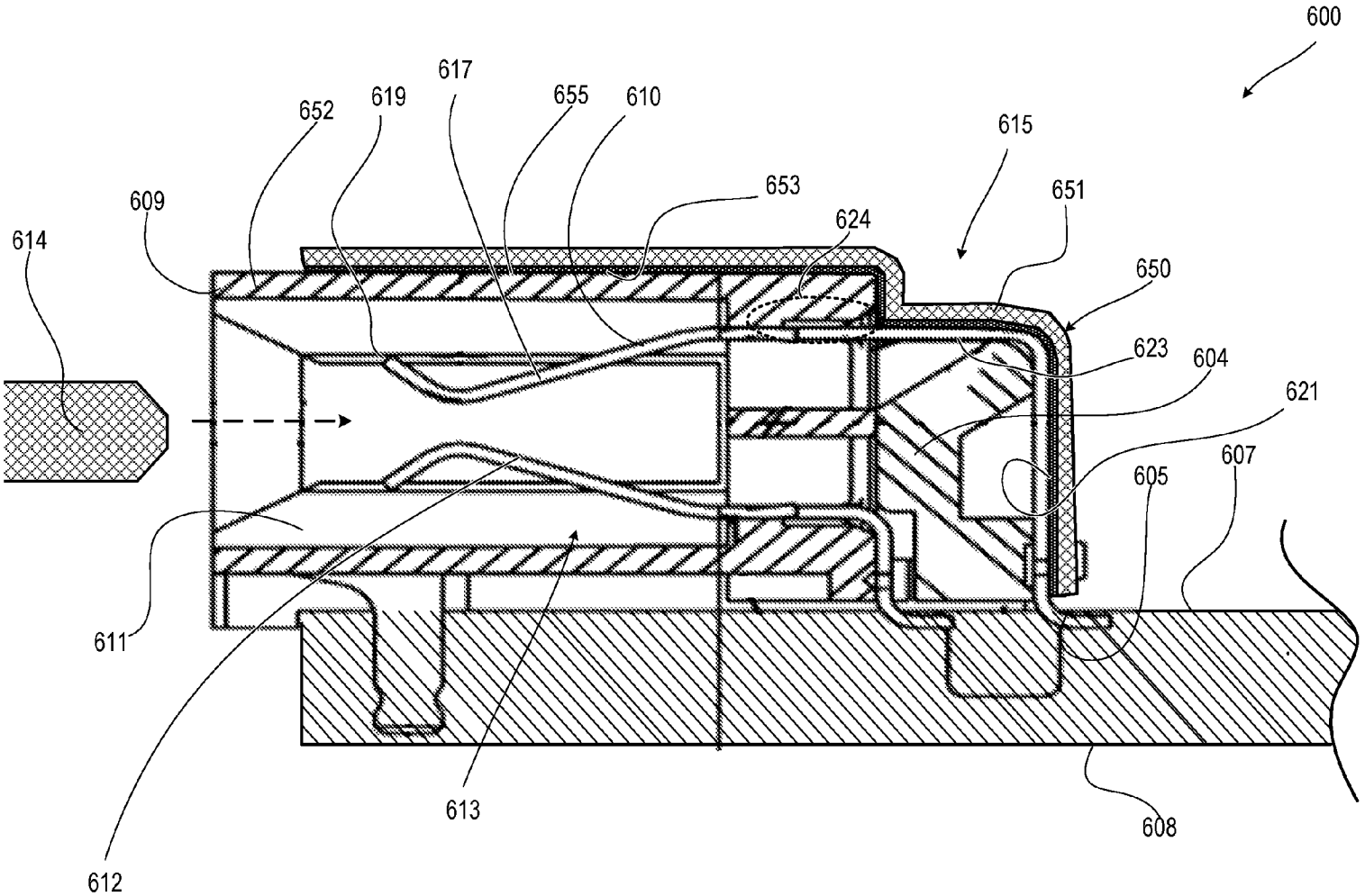
FIG. 6 illustrates a side cross section view of a reinforced edge card connector mounted on a PCB, according to one or more embodiments.

FIG. 6 illustrates an example IHS 600 that has a reinforcement component 650 of an outer plastic flexible sheet 651 attached by an adhesive layer 653. An edge card connector 652 that is mounted on a first PCB 608 such as MB has a terminal block 604 having a mounting surface 605 attached to a surface 607 of the first PCB 608. A connector housing 609 has connector opening 611 aligned in parallel to the surface 607 of the first PCB 608 to receive an edge of a second PCB 614.

An upper row 615 of upper conductors 610 and a lower row 613 of lower conductors 612 are positioned in respective opposition to frictionally engage opposite sides of the edge of the second PCB 614. Each of the upper conductors 610 are a cantilevered pin 617 with a distal portion 619 that is deflected outwardly from the first PCB 608 within the connector opening 611 of the connector housing 609. Each cantilevered pin 617 includes a mounting portion 621 that extends to the mounting surface 605 of the terminal block 604. Each cantilevered pin 617 includes a bent portion 623 that is attached between the distal portion 619 and the mounting portion 621. Each cantilevered pin 617 has a lance feature 624 that forms an interference attachment within the connector housing 609. Thereby the connector housing 609 is attached to the terminal block 604 by the lance feature 624 of the upper conductors 610. The connector housing 609 and the terminal block 604 expose at least the bent portion 623 of the cantilevered pins 617 of the upper row 615 of upper conductors 610. The reinforcement component 650 of the outer plastic flexible sheet 651 is attached by the adhesive layer 653 to an outward surface 655 of the connector housing 609 and to exposed surfaces of the upper row 615 of upper conductors 610 to create a binding force to multiple cantilevered pins 617 to resist deformation.

Figure 8:
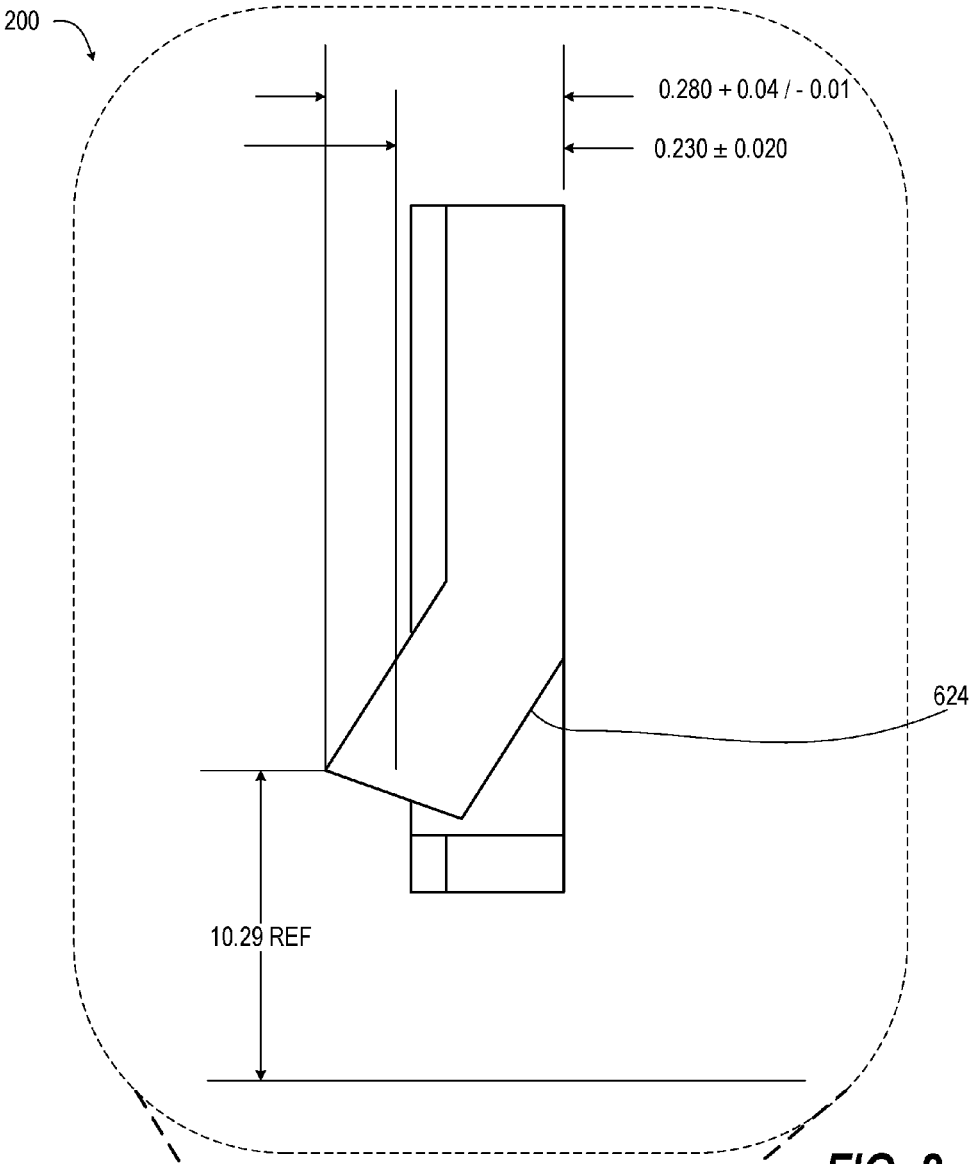
FIG. 8 illustrates a detail view of a lance feature of the edge card connector, according to one or more embodiments.
Figure 7:
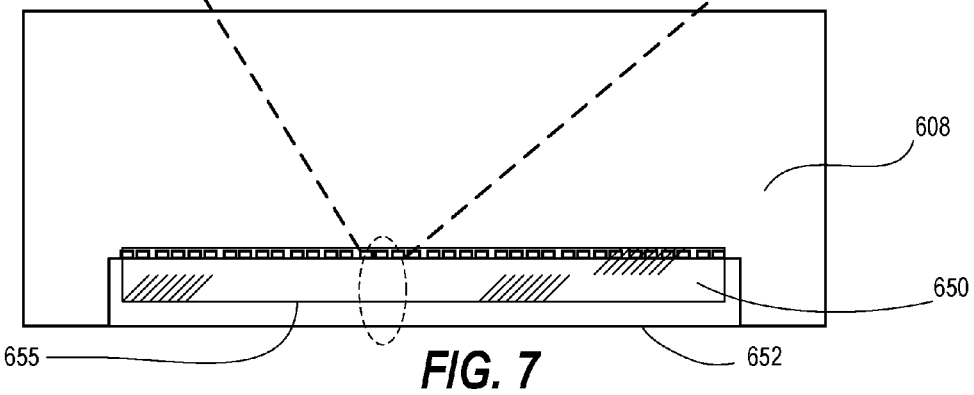
FIG. 7 illustrates a simplified diagram of a top view of the edge card connector of FIG. 6 mounted to an expansion card, according to one or more embodiments.

FIG. 7 illustrates the outward surface 655 of the edge card connector 652 of FIG. 6 mounted to first PCB 608 and protected by the reinforcement component 650. FIG. 8 illustrates the lance feature 624 of the edge card connector 652 that has a lance feature width of greater than the generally-known lance feature 124 (FIG. 1) according to one or more embodiments. In an exemplary embodiment, the lance feature 624 can be an angled knife edge having a lance feature width of not greater than 0.284 mm, such as 0.280+0.004−0.001 mm.

Figure 9:
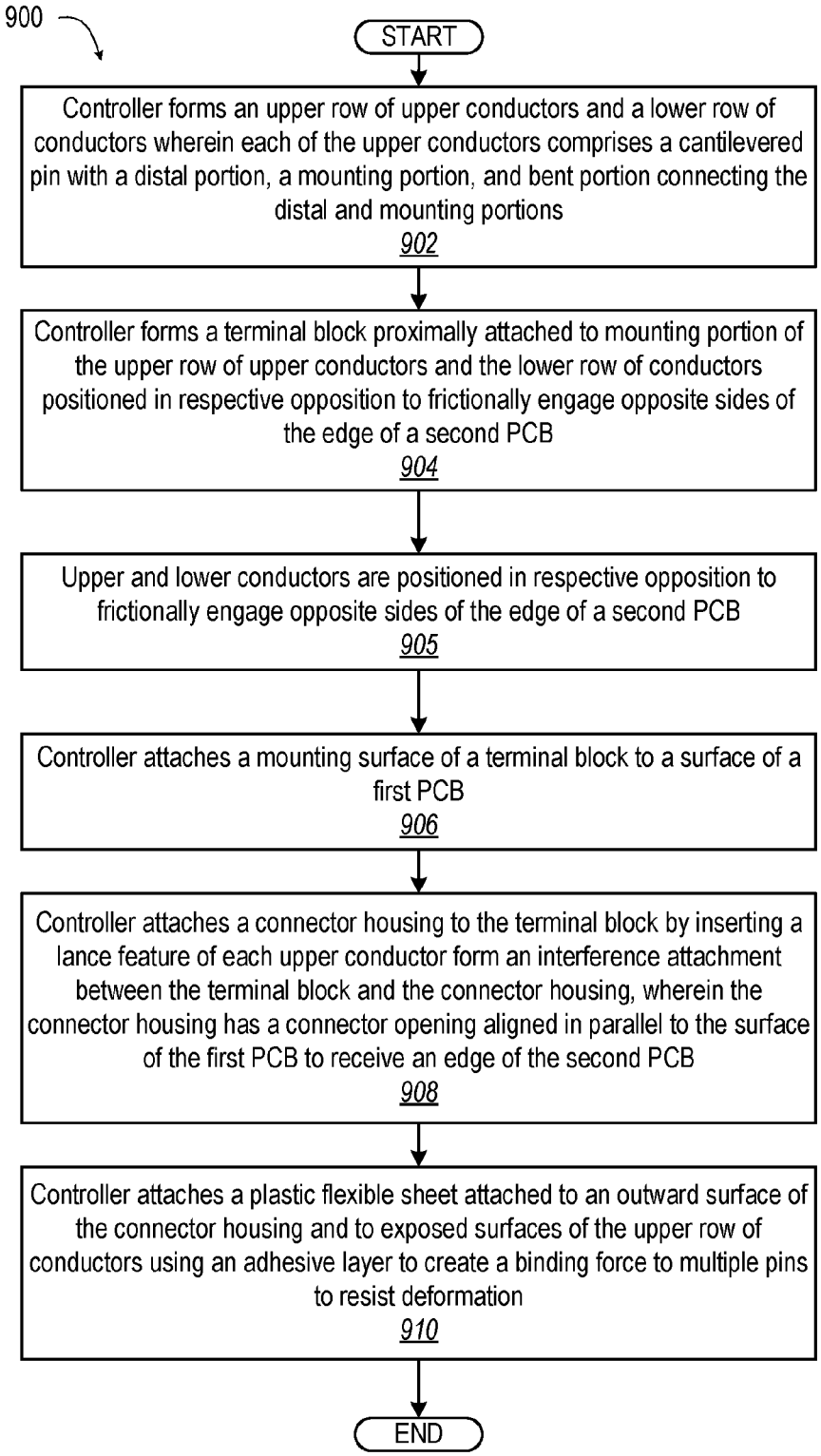
FIG. 9 illustrates a flow diagram of a method of fabricating a reinforced edge card connector, according to one or more embodiments.

FIG. 9 illustrates a flowchart of an exemplary method 900 by which an automated manufacturing controller 558 (FIG. 5) performs different aspects of the processes that enable the one or more embodiments of the disclosure. Generally, method 900 represents a computer-implemented method. The description of method 900 is provided with general reference to the specific components illustrated within FIG. 5. Generally method 900 is described as being implemented via processor 512 (FIG. 5). The method 900 thereby provides blind assembly of PCBs into an IHS with reduced failure rates. It is however appreciated that certain aspects of the described methods may be implemented via other processing devices and/or execution of other code.

FIG. 9 illustrates a method 900 of fabricating a reinforced edge card connector for mounting on a first PCB of an IHS. In one or more embodiments, the method 900 includes an automated manufacturing controller ("controller") forming an upper row of upper conductors and a lower row of lower conductors, where each of the upper conductors comprising a cantilevered pin with a distal portion, a mounting portion, and bent portion connecting the distal and mounting portions (block 902). The method 900 includes the controller forming a terminal block proximally attached to the mounting portion of the upper row of upper conductors and the lower row of lower conductors (block 904). The upper and lower conductors are positioned in respective opposition to frictionally engage opposite sides of the edge of a second PCB (block 905). The method 900 includes the controller attaching a mounting surface of a terminal block to a surface of a first PCB (block 906). The method 900 includes the controller attaching a connector housing to the terminal block by inserting upper conductors that comprise a cantilevered pin having a lance feature to form an interference attachment between the terminal block and the connector housing. The connector housing has a connector opening aligned in parallel to the surface of the first PCB to receive an edge of the second PCB (block 908). The method 900 includes the controller attaching a flexible sheet attached to an outward surface of the connector housing and to exposed surfaces of the upper row of upper conductors to create a binding force between multiple upper conductors to resist deformation. In one or more embodiments, an adhesive layer is placed between a plastic flexible sheet and the outer surface of the connector housing and the exposed surfaces of the upper row of upper conductors (block 910).

In one or more embodiments, the lance feature is an angled knife edge that laterally extends to form a lance feature width of more than 0.25 mm. In an exemplary embodiment, the lance feature has a lance feature width of not greater than 0.284 mm. In one or more embodiments, the edge card connector can be a Peripheral Component Interconnect Express (PCI-E) connection.

In the above described flow chart of FIG. 9, one or more of the methods may be embodied in an automated manufacturing controller that performs a series of functional processes. In some implementations, certain steps of the methods are combined, performed simultaneously or in a different order, or perhaps omitted, without deviating from the scope of the disclosure. Thus, while the method blocks are described and illustrated in a particular sequence, use of a specific sequence of functional processes represented by the blocks is not meant to imply any limitations on the disclosure. Changes may be made with regards to the sequence of processes without departing from the scope of the present disclosure. Use of a particular sequence is therefore, not to be taken in a limiting sense, and the scope of the present disclosure is defined only by the appended claims.

One or more of the embodiments of the disclosure described can be implementable, at least in part, using a software-controlled programmable processing device, such as a microprocessor, digital signal processor or other processing device, data processing apparatus or system. Thus, it is appreciated that a computer program for configuring a programmable device, apparatus or system to implement the foregoing described methods is envisaged as an aspect of the present disclosure. The computer program may be embodied as source code or undergo compilation for implementation on a processing device, apparatus, or system. Suitably, the computer program is stored on a carrier device in machine or device readable form, for example in solid-state memory, magnetic memory such as disk or tape, optically or magneto-optically readable memory such as compact disk or digital versatile disk, flash memory, etc. The processing device, apparatus or system utilizes the program or a part thereof to configure the processing device, apparatus, or system for operation.

While the disclosure has been described with reference to exemplary embodiments, it will be understood by those skilled in the art that various changes may be made and equivalents may be substituted for elements thereof without departing from the scope of the disclosure. In addition, many modifications may be made to adapt a particular system, device or component thereof to the teachings of the disclosure without departing from the essential scope thereof. Therefore, it is intended that the disclosure not be limited to the particular embodiments disclosed for carrying out this disclosure, but that the disclosure will include all embodiments falling within the scope of the appended claims. Moreover, the use of the terms first, second, etc. do not denote any order or importance, but rather the terms first, second, etc. are used to distinguish one element from another.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present disclosure has been presented for purposes of illustration and description, but is not intended to be exhaustive or limited to the disclosure in the form disclosed. Many modifications and variations will be apparent to those of ordinary skill in the art without departing from the scope of the disclosure. The described embodiments were chosen and described in order to best explain the principles of the disclosure and the practical application, and to enable others of ordinary skill in the art to understand the disclosure for various embodiments with various modifications as are suited to the particular use contemplated.

What is claimed is:

1. An information handling system (IHS) comprising:

a housing;

a first printed circuit board (PCB) received in the housing:

an edge card connector comprising:

a terminal block having a mounting surface attached to a surface of the first PCB;

a connector housing having a connector opening aligned to the surface of the first PCB to receive an edge of a second PCB;

an upper row of upper conductors and a lower row of lower conductors positioned in respective opposition to frictionally engage opposite sides of the edge of the second PCB, wherein each of the upper conductors comprises: (i) a distal portion that deflects outwardly from the first PCB within the connector opening of connector housing, (ii) a mounting portion that extends to the mounting surface of the terminal block, and (iii) a bent portion that is attached between the distal portion and the mounting portion, wherein the connector housing exposes the bent portion of the upper conductors of the upper row;

a flexible sheet attached to an outward surface of the connector housing and to exposed surfaces of the upper row of upper conductors to create a binding force to multiple upper conductors to resist deformation; and an adhesive layer between the flexible sheet and the outer surface of the connector housing and the exposed surfaces of the upper row of upper conductors.

2. The IHS of claim 1, wherein the upper conductors each comprise a cantilevered pin having a lance feature that forms an interference attachment between the terminal block and the connector housing.

3. The IHS of claim 2, wherein the lance feature comprises an angled knife edge that laterally extends.

4. The IHS of claim 2, wherein the lance feature comprises a lance feature width that is greater than a conventional lance feature width.

5. The IHS of claim 1, wherein the edge card connector comprises a Peripheral Component Interconnect Express (PCI-E) connection.

6. The IHS of claim 1, wherein the flexible sheet comprises a plastic sheet.

7. An edge card connector for mounting on a printed circuit board (PCB) of an information handling system (IHS), the edge card connector comprising:

a terminal block having a mounting surface attachable to a surface of a first PCB;

a connector housing having a connector opening aligned to the surface of the PCB to receive an edge of a second PCB;

an upper row of upper conductors and a lower row of lower conductors positioned in respective opposition to frictionally engage opposite sides of the edge of the second PCB, wherein each of the upper conductors comprises a distal portion that deflects outwardly from the first PCB within the connector opening of connector housing, a mounting portion that extends to the mounting surface of the terminal block, and a bent portion that is attached between the distal portion and the mounting portion, wherein the connector housing exposes the bent portion of the upper conductors of the upper row;

a flexible sheet attached to an outward surface of the connector housing and to exposed surfaces of the upper row of upper conductors to create a binding force to multiple cantilevered pins to resist deformation; and an adhesive layer between the flexible sheet and the outer surface of the connector housing and the exposed surfaces of the upper row of upper conductors.

8. The edge card connector of claim 7, wherein the upper conductors each comprise a cantilevered pin having a lance feature that forms an interference attachment between the terminal block and the connector housing.

9. The edge card connector of claim 8, wherein the lance feature comprises an angled knife edge that laterally extends.

10. The edge card connector of claim 8, wherein the lance feature comprises a lance feature width that is greater than a conventional lance feature width.

11. The edge card connector of claim 7, wherein the edge card connector comprises a Peripheral Component Interconnect Express (PCI-E) connection.

12. The edge card connector of claim 7, wherein the flexible sheet comprises a plastic sheet.

13. A method of fabricating a reinforced edge card connector for mounting on a first printed circuit board (PCB) of an information handling system (IHS), the method comprising:

forming an upper row of upper conductors and a lower row of lower conductors, wherein each of the upper conductors comprises a distal portion, a mounting portion, and a bent portion connecting the distal and mounting portions;

forming a terminal block proximally attached to the mounting portion of the upper row of upper conductors and the lower row of lower conductors positioned in respective opposition to frictionally engage opposite sides of the edge of a second PCB;

attaching a mounting surface of a terminal block to a surface of a first PCB;

attaching, to the terminal block, a connector housing having a connector opening aligned to the surface of the first PCB to receive an edge of the second PCB; and attaching a flexible sheet attached to an outward surface of the connector housing and to exposed surfaces of the upper row of upper conductors to create a binding force between multiple upper conductors to resist deformation, the attaching including applying an adhesive layer between the flexible sheet and the outer surface of the connector housing and the exposed surfaces of the upper row of upper conductors.

14. The method of claim 13, wherein attaching the connector housing to the terminal block comprises inserting an upper conductor comprising a cantilevered pin having a lance feature to form an interference attachment between the terminal block and the connector housing.

15. The edge card connector of claim 14, wherein the lance feature comprises an angled knife edge that laterally extends.

16. The edge card connector of claim 15, wherein the lance feature comprises a lance feature width that is greater than a conventional lance feature width.

17. The method of claim 13, wherein the applying of a flexible sheet comprises applying an adhesive layer between a plastic flexible sheet and the outer surface of the connector housing and the exposed surfaces of the upper row of upper conductors.

18. The method of claim 13, wherein the edge card connector comprises a Peripheral Component Interconnect Express (PCI-E) connection.

* * * * *